US011129252B2

(12) United States Patent
Pruitt

(10) Patent No.: US 11,129,252 B2
(45) Date of Patent: Sep. 21, 2021

(54) OUTPUT STABILIZATION OF MIXED COLOR TEMPERATURE LED LIGHTING SYSTEMS

(71) Applicant: Elemental LED, Inc., Reno, NV (US)

(72) Inventor: Adam L Pruitt, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/178,830

(22) Filed: Feb. 18, 2021

(65) Prior Publication Data

US 2021/0259075 A1 Aug. 19, 2021

Related U.S. Application Data

(60) Provisional application No. 62/978,284, filed on Feb. 18, 2020.

(51) Int. Cl.
*H05B 45/20* (2020.01)
*H05B 47/165* (2020.01)

(52) U.S. Cl.
CPC ..... *H05B 45/20* (2020.01); *H05B 47/165* (2020.01)

(58) Field of Classification Search
CPC ..... H05B 45/20; H05B 47/165
See application file for complete search history.

(56) References Cited

U.S. PATENT DOCUMENTS 9,425,896 B2 8/2016 Harbers et al.
9,723,680 B2 8/2017 Pope et al.
10,212,779 B1 2/2019 Herbst et al.
2008/0068859 A1 3/2008 Ng et al.
2014/0035472 A1 2/2014 Raj et al.
2015/0289344 A1* 10/2015 Leadford ..... H05B 47/16 315/294
2015/0345724 A1* 12/2015 Leadford ..... F21V 23/003 362/244
2020/0314976 A1* 10/2020 Soer ..... H05B 45/20
2021/0081313 A1* 3/2021 Jang ..... G06F 12/0246

FOREIGN PATENT DOCUMENTS

WO 2007132573 A1 11/2007
WO 2010036869 A3 7/2010
WO 2011146104 A1 11/2011

OTHER PUBLICATIONS

Ohno, Yoshi and Fein, Mira, "Vision Experiment on White Light Chromaticity for Lighting: Duv Levels Perceived Most Natural," CIE/USA-CNC/CIE Biennial Joint Meeting, Davis, CA, Nov. 7-8, 2013.
International Search Report issued in International Application No. PCT/US2021/018553 dated May 3, 2021.
Written Opinion issued in International Application No. PCT/US2021/018553 dated May 3, 2021.

* cited by examiner

*Primary Examiner* — Daniel D Chang
(74) *Attorney, Agent, or Firm* — United IP Counselors, LLC

(57) ABSTRACT

Methods and systems for controlling compound ramps in LED luminaires and lighting circuits are disclosed. In a compound ramp, the light output of one set of LED light engines increases while the light output of another set of LED light engines decreases. During such a ramp, the methods and systems may control the total light output to keep it relatively constant. In some embodiments, the methods and systems may also control the color of the emitted light maintain ideal color characteristics.

9 Claims, 6 Drawing Sheets
(3 of 6 Drawing Sheet(s) Filed in Color)

OUTPUT STABILIZATION OF MIXED COLOR TEMPERATURE LED LIGHTING SYSTEMS

CROSS-REFERENCE TO RELATED APPLICATIONS

This application claims priority to U.S. Provisional Patent Application No. 62/978,284, filed Feb. 20, 2020. The contents of that application are incorporated by reference in their entirety.

TECHNICAL FIELD

The invention relates to LED lighting, and particularly, to controlling the light output of LED lighting that uses LED light engines of different color temperatures or characteristics.

BACKGROUND

LED lighting, a form of solid-state lighting, has supplanted traditional incandescent and fluorescent lighting as the dominant type of lighting in both residential and commercial settings. However, LED lighting produces light differently than legacy light sources, and does not necessarily mimic the behaviors of legacy light sources.

Typically, an LED luminaire includes a number of LED light engines. An LED light engine usually includes one or several light-emitting diodes in a package that makes it easy to mount the light engine on a printed circuit board. For example, LED light engines are often surface-mounted on a rigid or flexible printed circuit board.

There are several different ways that LED light engines can be used to produce different colors of light. One of the most straightforward is by additive color mixing. In that case, red, green, and blue LEDs are used, usually in the same light engine. Red, green, and blue light can then be mixed by activating the individual LEDs at different intensities to produce a variety of different light colors, including a variety of different shades of "white" light.

If the objective of the luminaire is to produce "white" light for ambient or task lighting, optically-pumped LED light engines are frequently used. In an optically-pumped LED light engine, pump LEDs emit a particular wavelength or narrow spectrum of light, which is then absorbed by a phosphor and re-emitted in a desired spectrum. Most commonly, the pump LEDs are blue-light emitting.

Although most light used in ambient and task lighting is colloquially referred to as "white" light, this description is inadequate. "White" light may actually have many different colors, ranging from the "warm" orange-yellow hue of a traditional incandescent lamp to the "cool" bluish-white hue of sunlight or a fluorescent lamp.

There are many different ways of describing the color of light. Correlated color temperature (CCT), expressed in units of degrees Kelvin, is one of the primary metrics for evaluating and describing the color of white light. Lower CCTs (e.g., 1800-3000K) denote "warmer" white light, with yellow and red wavelengths more dominant in the light spectrum; higher CCTs (e.g., 5000-6000K) denote "cooler" white light, with blue wavelengths more dominant in the spectrum.

LED luminaires often include more than one type of LED light engine. For example, an LED luminaire may include separate sets of blue-pump LED light engines with different CCTs, usually one with a "warmer" CCT and one with a "cooler" CCT. Physically, these light engines usually differ only in the composition of the phosphor that absorbs and re-emits light, with one phosphor composition tailored to produce, e.g., 2700K light and the other tailored to produce, e.g., 5000K light. This allows the output of the luminaire to shift from warm to cool white light, or vice-versa, at the option of the user. In some cases, LED light engines with different CCTs may be used to mimic a specific behavior of legacy incandescent lamps: the tendency for the light to grow warmer (i.e., to drop in color temperature) as the lamp is dimmed. This particular type of CCT shifting is often referred to as "dim to warm."

The process of shifting from using one set of LED light engines to another set of LED light engines is fraught with difficulties. Transitions can be sudden, and in many cases, the luminaire's light output drops undesirably as one set of LED light engines ramps its output down and another set of LED light engines ramps up.

BRIEF SUMMARY

Aspects of the invention relate to LED luminaires with multiple types of LED light engines, each type having different characteristics, and to methods for controlling the light output of such luminaires, particularly during transitions from one state to another. During a compound ramp, in which one set of LED light engines is decreasing in light output and another set of LED light engines is increasing in light output, methods according to embodiments of the invention are adapted to keep the overall light output of the luminaire substantially constant.

Methods according to other aspects of the invention may also function to maintain an ideal color of the light output during transitions such as compound ramps. Maintaining an ideal color of light during transitions may involve changing the color temperature of the light in ways that mimic a black body radiator.

Other aspects, features, and advantages of the invention will be set forth in the description that follows.

BRIEF DESCRIPTION OF THE DRAWING FIGURES

The patent or application file contains at least one drawing executed in color. Copies of this patent or patent application publication with color drawing(s) will be provided by the Office upon request and payment of the necessary fee.

The invention will be described with respect to the following drawing figures, in which like numerals represent like features throughout the description, and in which.

Figure 5:
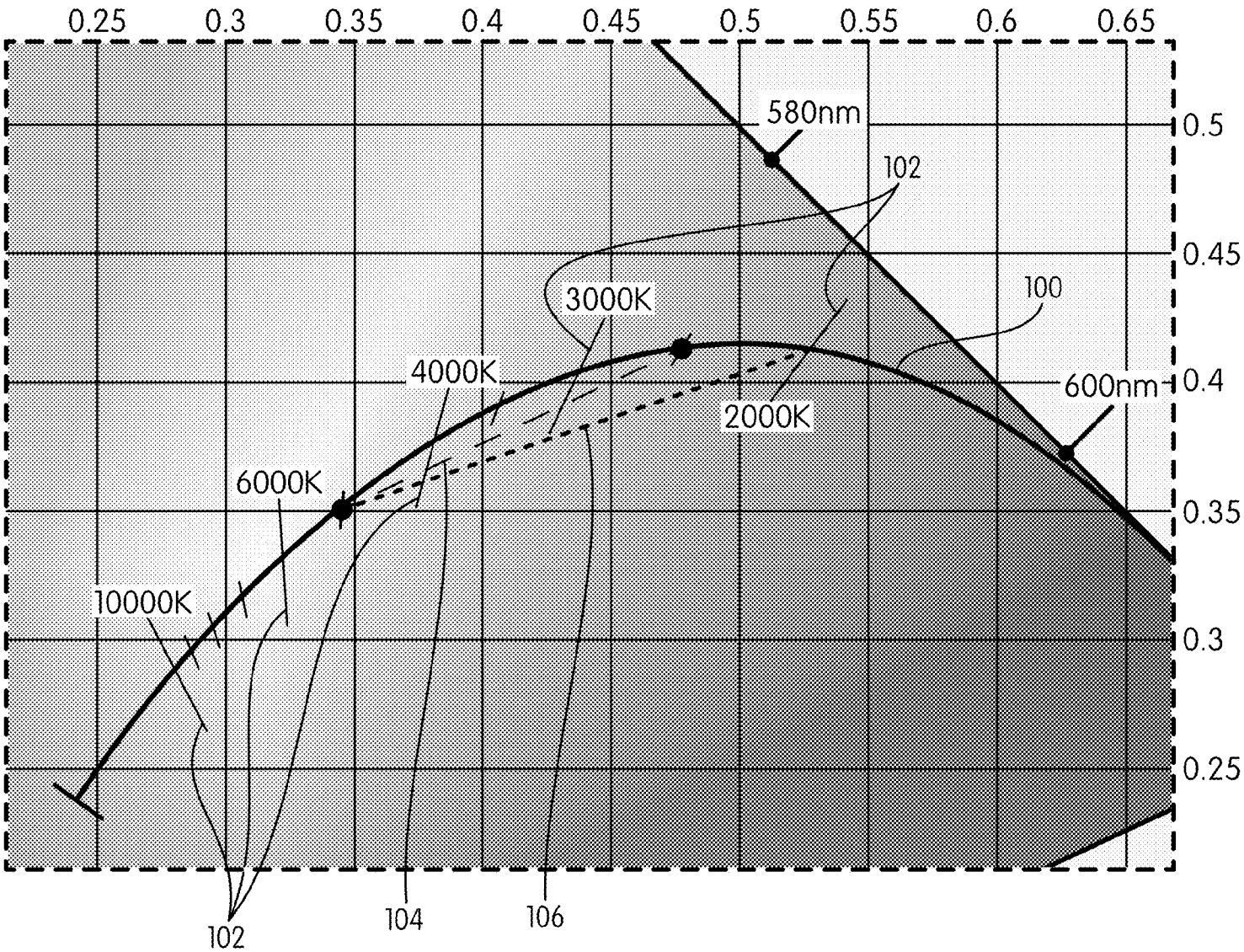
Figure 6:
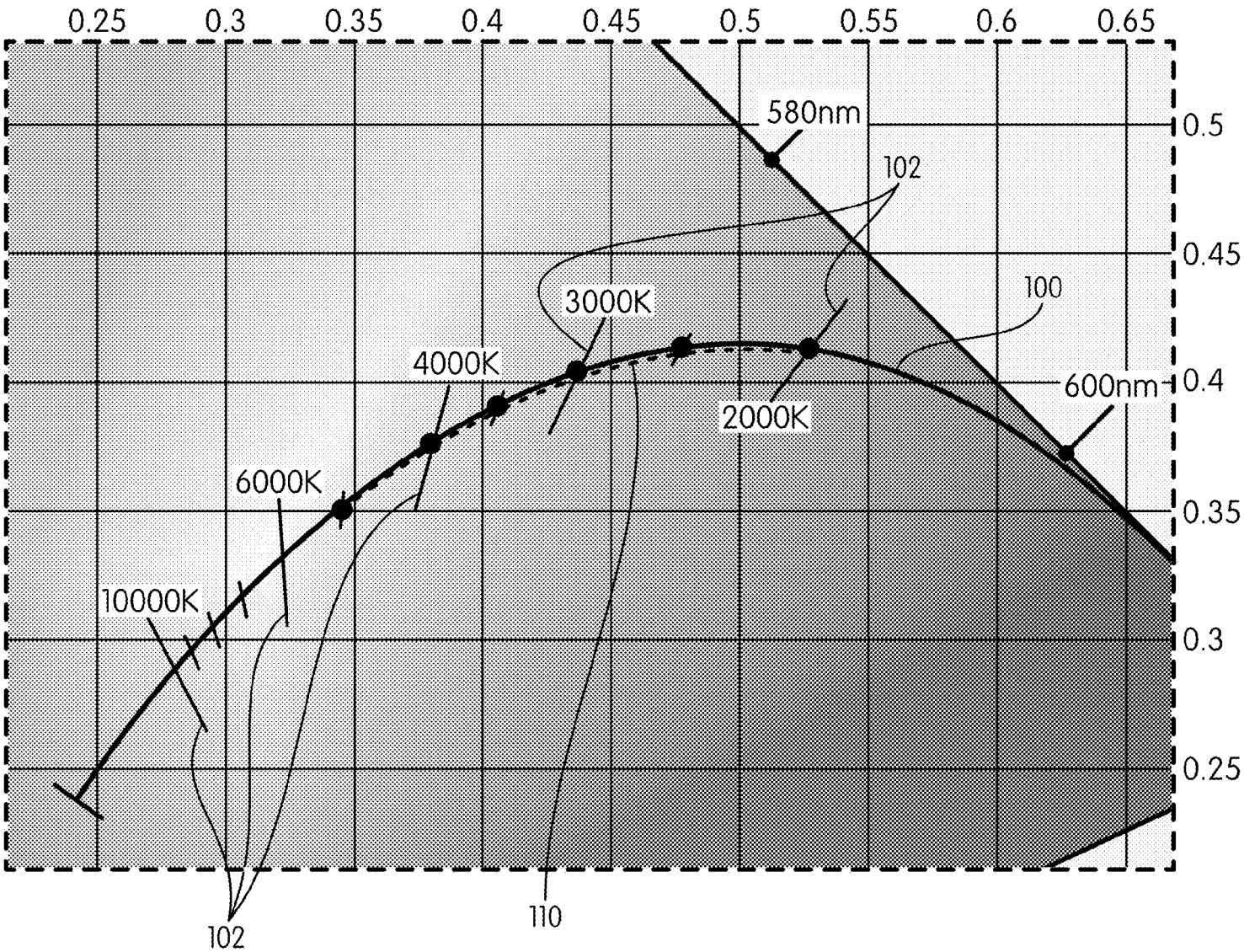

FIG. 5 is a rendering of a portion of the 1931 CIE color space, illustrating a linear color transition from a first color temperature to a second color temperature relative to the Planckian locus; and FIG. 6 is a rendering of a portion of the 1931 CIE color space similar to FIG. 5, illustrating a segmented linear color transition from a first color temperature to a second color temperature relative to the Planckian locus.

DETAILED DESCRIPTION

Figure 1:
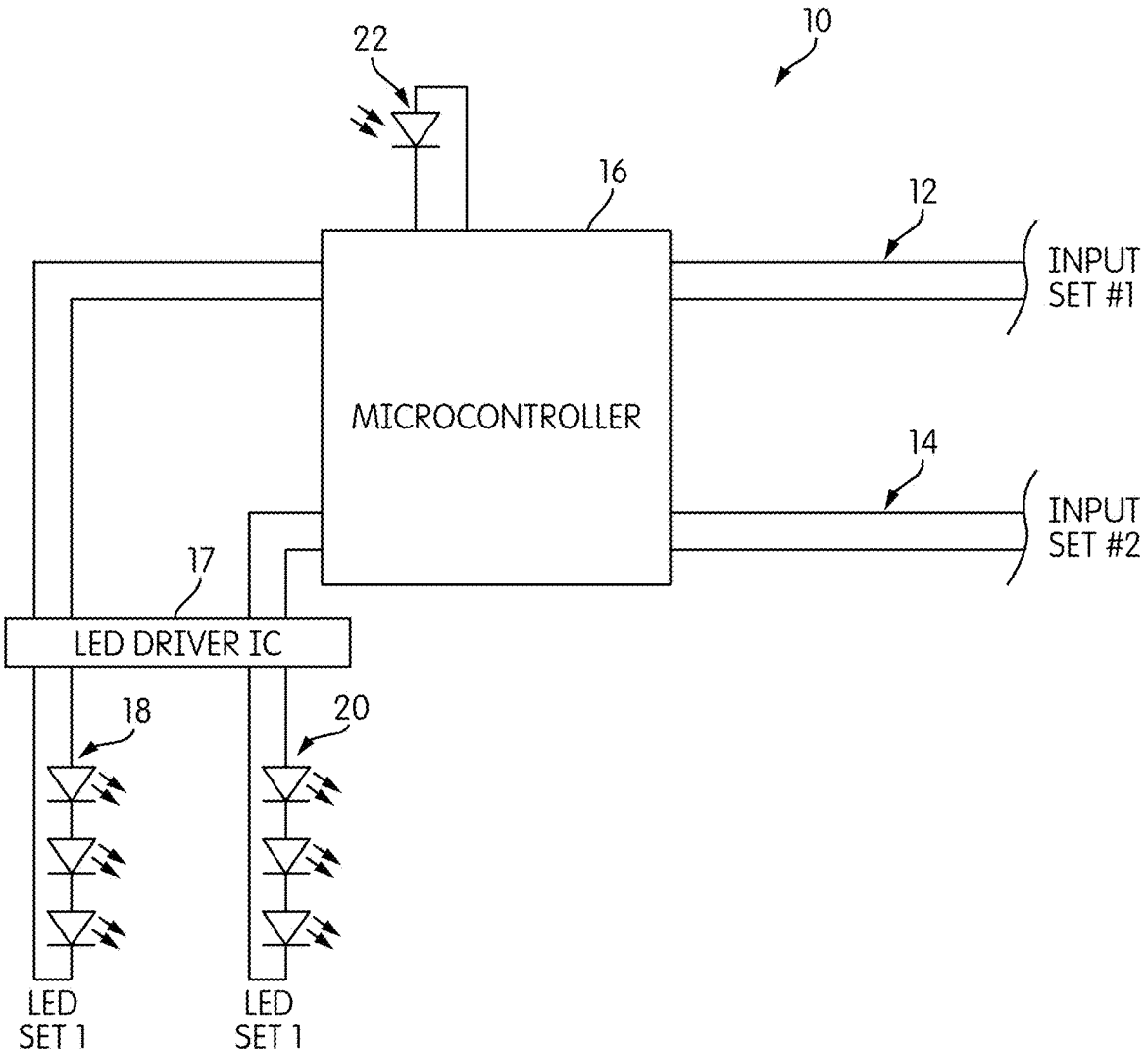
FIG. 1 is a schematic diagram of an LED lighting circuit according to one embodiment of the invention.

FIG. 1 is a schematic diagram of an LED lighting circuit, generally indicated at 10. The LED lighting circuit 10 takes two pairs of analog or digital voltage inputs 12, 14 and uses a microcontroller 16, or a similar component, to control two associated sets of LEDs 18, 20, each on its own separate circuit, in accordance with the voltage inputs 12, 14.

The LED lighting circuit 10 may be a circuit for a standalone LED luminaire, or it may represent one repeating block in a strip of LED linear lighting. U.S. Pat. No. 10,028,345, the contents of which are incorporated by reference herein in their entirety, discusses LED linear lighting in general, and the meaning of the term "repeating block." Broadly, linear lighting is a particular class of LED solid-state lighting in which an elongate, narrow printed circuit board (PCB) is populated with a number of LED light engines, typically spaced from one another at a regular pitch or spacing. A strip of linear lighting is typically divided into a number of repeating blocks by cut points. A repeating block is the fundamental functional unit of the linear lighting; it will function when cut from the rest of the strip of linear lighting and connected to power. Relevant here, although the LED light engines may be physically in series with one another on a strip of linear lighting, they may have various electrical arrangements.

In the illustration of FIG. 1, the sets of LED light engines 18, 20 are isolated from one another they are physically and electrically separate. However, in some cases, the two sets of LED light engines 18, 20 may share a common cathode or a common anode. Moreover, although this description may refer to two or more sets of LED light engines 18, 20 as distinct entities, it is possible to create a single LED light engine that is capable of emitting light of two different color temperatures. This is usually done by selecting a large package, such as a 5050 SMD LED package, including separately-controlled sets of blue-pump LEDs in the package, and covering one half of the package with a first phosphor and the second half of the package with a second phosphor. Because the two sets of LED light engines 18, 20 need not be physically separate from one another, references to two or more sets of LED light engines in this text should be construed to cover situations in which two (or more) sets of LED light engines are physically in a single set of LED packages.

While certain portions of this description may refer to linear lighting, the methods described here are applicable to any type or arrangement of LED lighting circuit. The LED light engines 18, 20 need not be arranged in linear fashion. As another example, the LED lighting circuit 10 could be incorporated into the physical form of a classic Type A lightbulb.

The LED lighting circuit 10 may operate at either low voltage or high voltage, although the remainder of this description will assume that it operates at low voltage. Although the definitions of "low voltage" and "high voltage" vary depending on the authority one consults, for purposes of this description, high voltage should be considered to be any voltage over about 50V. Low voltage LED lighting typically operates at 12V or 24V direct current (DC), although some low voltage lighting operates at higher voltages, e.g., 36V or 48V. The actual number of LED light engines in any particular set 18, 20 may vary considerably from embodiment to embodiment depending, at least in part, on the operating voltage.

The microcontroller 16 may be a microcontroller per se, or it may be a microprocessor, an application-specific integrated circuit (ASIC), a field-programmable gate array (FPGA), or any other component capable of performing the functions ascribed to it in this description. Thus, the term "microcontroller" should be read broadly to encompass all computing elements capable of performing the desired functions.

The microcontroller 16 may be directly connected to and between the inputs 12, 14 and the sets of LED light engines 18, 20. However, an LED lighting circuit typically requires some element to set the current level in the circuit, and a microcontroller 16 may not be capable of handling the current or voltage levels necessary to drive the LED light engines 18, 20 directly. For at least those reasons, an LED driver IC 17 would typically be connected between the microcontroller 16 and the sets of LED light engines 18, 20. As one example, the LED driver IC 17 may be a TLC59116 constant-current LED driver (Texas Instruments, Dallas, Tex., United States). That particular LED driver IC 17 is a 16-channel driver IC, meaning that it can control up to 16 sets of LED light engines 18, 20. Similar driver ICs with fewer channels and less resolution may be used in other embodiments, depending on the number of sets of LED light engines 18, 20 that are a part of the LED lighting circuit 10 and the level of adjustability in light output levels that is needed. That latter factor, adjustability, will be described in more detail below.

As was described briefly above, the lighting circuit 10 may accept only low-voltage DC power, or it may accept high-voltage AC power and have components that convert the high-voltage AC power to low-voltage DC power. In that case, the lighting circuit 10 would typically be divided into high-voltage and low-voltage sides, with the microcontroller 16 on the low-voltage side. Even on the low-voltage side, the lighting circuit 10 may have voltage conversion elements, e.g., buck converters, boost converters, etc. to supply specific voltages needed by various components. For example, the lighting circuit 10 may take a 24 VDC input and have converters that reduce the input 24 VDC to 3.3 VDC or 5 VDC to power the microcontroller 16, the LED driver IC 17, and other such components. On the other hand, if there are a particularly large number of LED light engines 18, 20 in a single circuit, the lighting circuit 10 may need to boost the input voltage to 28V, 36V, 48V, etc.

While the microcontroller 16 is shown as a single element for ease in illustration, other elements, such as memory, may be present. Additionally, the microcontroller 16 may be implemented as a so-called "system on a chip" that includes a microcontroller or other such device along with memory, serial and other communication circuits, and other such components. While it will often be the case that there is one microcontroller 16 for each lighting circuit 10, in some cases, for example, if there are a number of repeating blocks on a single strip of linear lighting, there may be one microcontroller 16 for several repeating blocks or lighting circuits 10.

In FIG. 1, a photodiode 22 is shown as connected to the microcontroller 16. That connection may be direct or indirect, e.g., the photodiode 22 may be connected through a filter, amplifier, or other such components. The photodiode 22 is an optional component whose purpose will be explained in greater detail below. In some cases, a photodiode array may be used instead of a single photodiode 22.

The precise details of the lighting circuit 10 are not critical to the invention. However, regardless of the particular circuit topology, the microcontroller 10 and/or any LED driver IC would typically be capable of accepting instructions using a standard lighting control protocol, such as DMX or DALI, and modulating the light output using a standard modulation scheme, such as pulse-width modulation (PWM). In this embodiment, the microcontroller 16 is capable of interpreting standard lighting control protocol instructions and instructing the LED driver IC 17, which applies a PWM signal to the LED light engines 18, 20 themselves.

Figure 2:
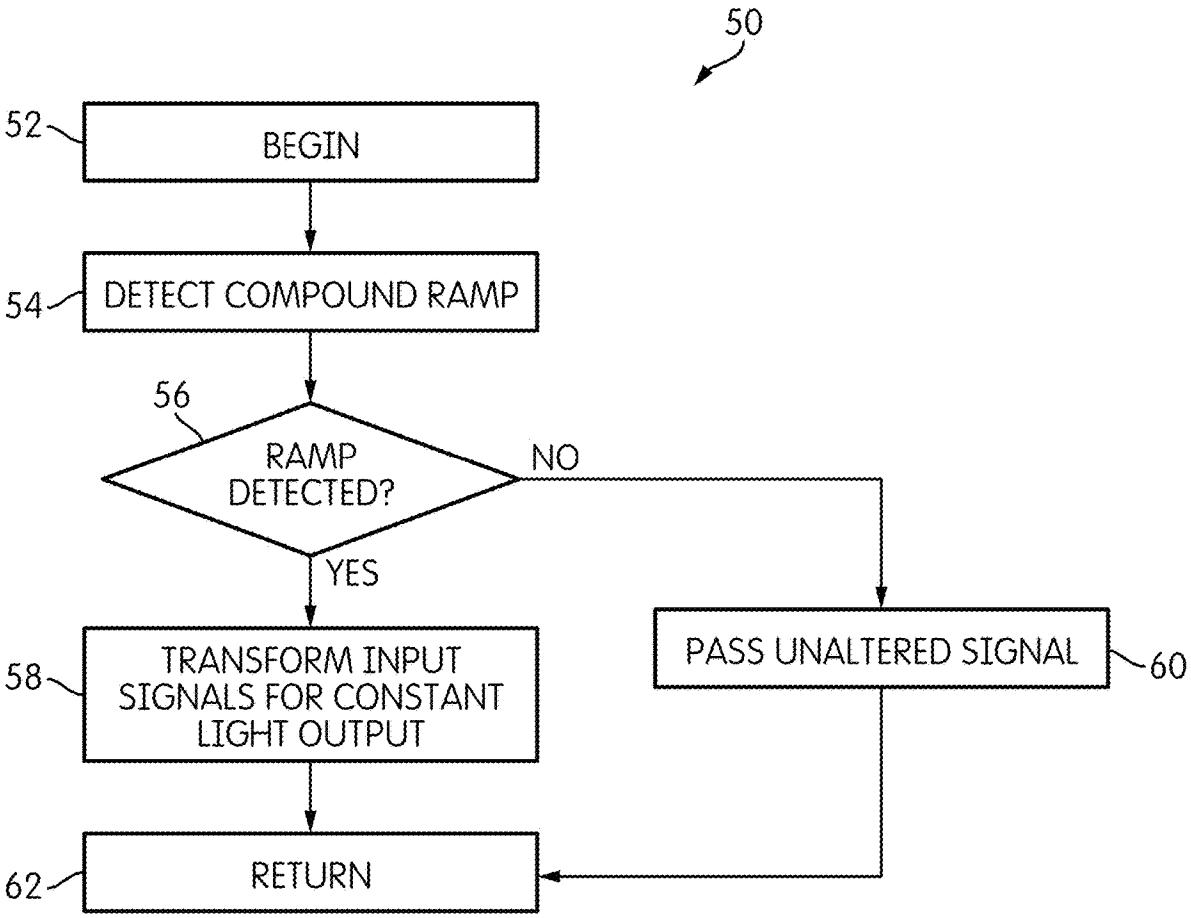
FIG. 2 is a flow diagram of a method for stabilizing the output of a lighting circuit such as the lighting circuit of FIG. 1.

FIG. 2 is a schematic flow diagram of a method, generally indicated at 50, for stabilizing and keeping the light output of a lighting circuit 10 substantially constant despite a change in relative outputs of different sets of LED light engines 18, 20 in the circuit 10. Method 50 begins at task 52 and continues with task 54.

While the microcontroller 16 exerts general control over the sets of LED light engines 18, 20 and may cause them to perform many functions, method 50 focuses on detecting and acting in situations in which the relative outputs of different sets of LED light engines 18, 20 change simultaneously or nearly simultaneously and it is desirable to control all of the sets of LED light engines 18, 20 in concert during that change to achieve an overall result.

Figure 3:
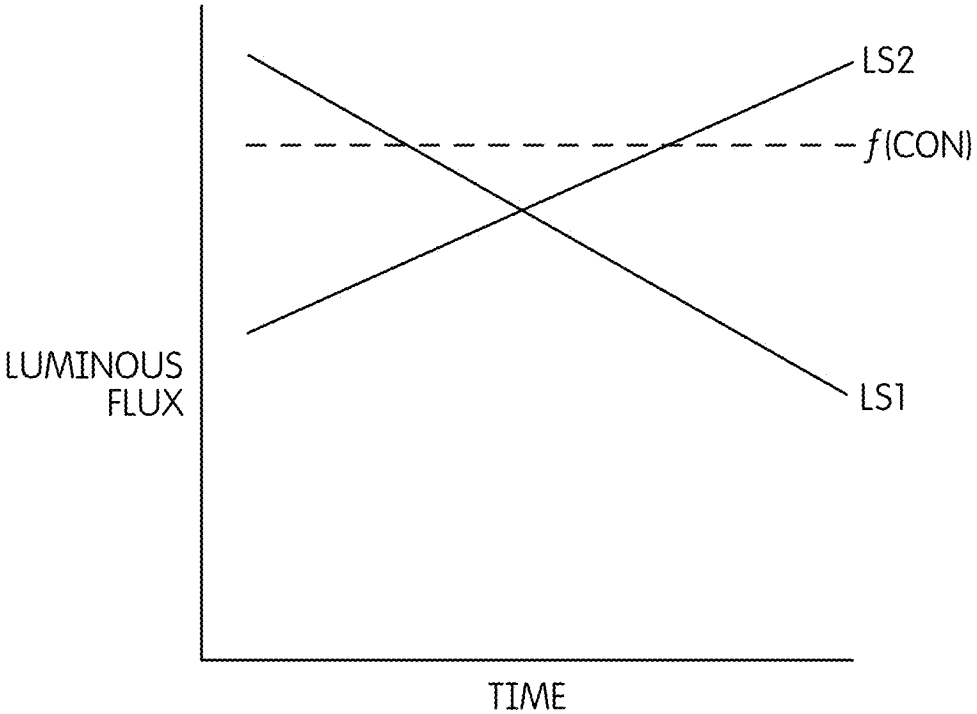
FIG. 3 is a graph of an exemplary compound ramp.

FIG. 3 is an example of a "compound ramp," one example of a situation in which it may be desirable to control different sets of LED light engines 18, 20 in concert. When a user desires to switch the color temperature of the light emitted by a lighting circuit 10, rather than instantaneously shutting one set of LED light engines 18 off while activating the other, a controller typically ramps down the light output of one set of LED light engines 18 gradually while gradually ramping up the light output of the other set of LED light engines 20. This is shown schematically in the graph of FIG. 3, which plots the luminous flux (i.e., light output) of two sets of LED light engines LS1, LS2 during a typical ramp. As shown, a first set of LED light engines LS1 is being ramped down while, at the same time, another set of LED light engines LS2 is being ramped up.

The ramps shown in FIG. 3 are linear, although they need not be—because of human perception and preferences, and for other reasons, a controller may execute non-linear ramps. Additionally, a ramping or transition operation need not result in one set of LED light engines 18 outputting nothing while the other set of LED light engines 20 outputs 100% of the light; instead, multiple sets of LED light engines 18, 20 may emit light at the same time, resulting in a blended light output with a CCT that is between the CCTs of the two sets 18, 20. In any case, the term "compound ramp" means that a first operation is being performed on one set of LED light engines 18, 20 to change its light output while at or about the same time, a second operation is being performed on a second set of LED light engines 18, 20 to change its light output. The most common type of compound ramp may be an increase in the light output of one set of LED light engines 18, 20 and a decrease in the light output of another set of LED light engines 18, 20, but this is not necessarily the only type of compound ramp. Any kind of transition that potentially involves changes in light output between two or more sets of LED light engines 18, 20 falls within the ambit of method 50 and other methods according to embodiments of the invention.

As will be described below, one objective of method 50 is to maintain the overall light output of the LED lighting circuit 10 during a compound ramp that includes both an increase in the light output of one set of LED light engines 18, 20 and the decrease in the light output of another set of LED light engines 18, 20. This constant output is shown in FIG. 3 as $f$(con).

In task 54 of method 50, the microcontroller 16 determines if a compound ramp or other applicable transition has been instructed by examining the inputs 12, 14. It may take a short period of time after initiation of the compound ramp for it to be detected. In the simplest embodiments, the detection process may simply involve detecting a rise in one set of inputs 12, 14 and a simultaneous, or near-simultaneous, fall in another set of inputs 12, 14. In some cases, the inputs 12, 14 may be in the form of analog voltages that are supplied to the microcontroller 16 and converted by means of analog-to-digital converters (not shown in FIG. 1). Analog input voltages may be used, e.g., in the case of some 0-10V dimming systems.

In many cases, the inputs 12, 14 will be digital. If the inputs 12, 14 are digital, these rises, falls, and ramps would typically be implemented as changes, or instructions to change, the PWM duty cycle of one set of LED light engines 18, 20 versus the other. A "rise" in light output corresponds to an increase in PWM duty cycle and a "fall" in light output corresponds to a decrease in PWM duty cycle. Here, the term "ramp" refers specifically to a gradual change, either a rise or a fall. As those of skill in the art will appreciate, PWM lighting control schemes do not actually change the magnitude of the light emitted by the sets LED light engines 18, 20. Instead, they switch the sets of LED light engines 18, 20 on and off rapidly, typically in the kilohertz range, much faster than the human eye can perceive. The more the sets of LED light engines 18, 20 are on (i.e., the greater the duty cycle), the brighter the emitted light is perceived to be.

There are other ways in which a ramp may be detected, depending on the manner in which the LED light engines 18, 20 are controlled. For example, in many situations, lighting control may involve a number of "scenes," i.e., lighting settings that are stored in memory for possible execution when commanded. Rather than providing direct control instructions for the sets of LED light engines 18, 20 in the form of analog voltages or PWM duty cycles, an input 12, 14 to the microcontroller 16 may dictate that a particular scene already stored by the microcontroller 16 is to be executed and leave the details (i.e., PWM duty cycles for each set of LED light engines 18, 20, etc.) to the local microcontroller 16 and LED driver IC 17. The triggering of a new scene may be an indication that a compound ramp is to be executed.

Method 50 continues with task 56, a decision task. In task 56, if a compound ramp is detected (task 56:YES), control of method 50 passes to task 58. If a compound ramp is not detected (task 56:NO), control of method 50 passes to task 60.

In task 58, the inputs 12, 14 are transformed using a function that is intended to execute the compound ramp without diminishing the overall light output of the lighting circuit 10. The output of the transformation function is passed to the sets of LED light engines 18, 20 instead of the voltages of the original inputs 12, 14.

The function used in task 58 may be a pre-established function determined empirically. For example, a lighting circuit 10 could be connected to the specific controller of interest and placed in a test device such as an integrating sphere, using a modified version of the LM-79 photometric testing protocol. The compound ramp behavior could be triggered, and the integrating sphere and its associated meters could be programmed to sample the lighting circuit's luminous flux and other characteristics at several times during the compound ramp. A function that maintains the light output of the lighting circuit 10 at a constant or near-constant luminous flux value during the compound ramp could then be created using conventional techniques based on the empirical data.

Pre-establishing a suitable function for correcting the light output is helpful in that it reduces the amount of computation necessary during an actual compound ramp, when action may need to be taken quickly to maintain light output. The above discussion presupposes that the necessary transformation or adjustment to the typical compound ramp is worked out in advance. If necessary, feedback control during the compound ramp may be used to perform task 58 of method 50. For example, if present, the photodiode 22, or an array of photodiodes 22, could be used for purposes of feedback control. (In some cases, photodiodes 22 sensitive to particular wavelengths of light may be used.) In that case, in task 58, feedback from the photodiodes could be used to alter the light output of each set of LED light engines 18, 20 to maintain the total light output of the lighting circuit 10.

Any other suitable method of determining a proper transform function or other adjustments that should be made to a compound ramp to maintain light output may be used.

In task 60 of method 50, it is assumed that the microcontroller 16 has directed some change to the light output of the lighting circuit 10 that is not a compound ramp. In that case, the voltages may be passed to the sets of LED light engines 18, 20 without modification. However, in some cases, the inputs 12, 14 may be filtered to smooth them, to prevent large spikes, or to make other such modifications, even without a transformation such as that described with respect to task 58.

Method 50 terminates and returns at task 62. Typically, a method such as method 50 would be performed continuously as long as the lighting circuit 10 is active. However, in some embodiments, it may be possible to disable methods like method 50, so that the inputs 12, 14 are passed to the sets of LED light engines 18, 20 without modification regardless of the circumstances.

It should be understood that in method 50 and other methods according to embodiments of the invention, it is not always necessary to keep the light output exactly the same during a transition. Some level of luminous flux diminishment may occur and be acceptable. As shown in FIG. 3, the constant light output achieved during the ramp, $f(\text{con})$ is less than the peak luminous output of either set of LED light engines LS1, LS2.

Moreover, while this description refers to the constancy of the luminaire's total luminous flux, in many cases, it is the constancy and maintenance of the luminaire's perceived brightness that is the more important. "Brightness" is a quality distinct from the luminous flux of the luminaire, and depends on human perception. Thus, the term "substantially constant," as applied to luminous flux, contemplates that the luminous flux may fluctuate 5%, 10% or even somewhat more during a transition.

The premise of method 50 is that the microcontroller 16 for the series of LED light engines 18, 20 intercepts and adapts or interprets instructions that it is given to keep the overall light output constant during a compound ramp or another such transition in which two or more sets of LED light engines 18, 20 are active. However, in many cases, it may not be necessary to intercept and alter instructions. Rather, it may be possible to achieve the same results as in method 50 by simply planning any transition with the necessary instructions to maintain the overall light output during the transition. This could be done by performing any transition using a pre-established function or set of steps.

For example, if transitions are handled by transitioning from one pre-stored "scene" to another, all of the scenes may be analyzed in advance to determine which transitions will involve compound ramps. Given that analysis, the microcontroller 16 may modify any scenes in advance, or insert a new "transition" scene or scenes, to handle a compound ramp between scenes.

The above example assumes that two separate sets of LED light engines 18, 20 are involved in a compound ramp. However, a compound ramp may involve more than two sets of LED light engines changing their light outputs at the same time. This may occur, for example, if warm white, neutral white, and cool white LED light engines are used simultaneously, or if there is another type of additive color mixing, for example, using red, green, and blue LEDs.

If more than two separate sets of LED light engines are involved in a compound ramp, the appropriate settings at each phase in a transition may be established empirically, e.g., by placing the luminaire or the sets of LED light engines in an integrating sphere and measuring the luminous flux at various points during a transition to determine the correct outputs for each set of LED light engines at each applicable point in the transition. Alternatively, a photodiode 22 or array of photodiodes 22 could be used for feedback control over a complex transition.

The above description focuses on keeping the light output, i.e., the total luminous flux and/or perceived brightness, constant during transitions. However, there is another consideration that may be taken into account in some embodiments: maintaining an ideal color of light during transitions.

Figure 4:
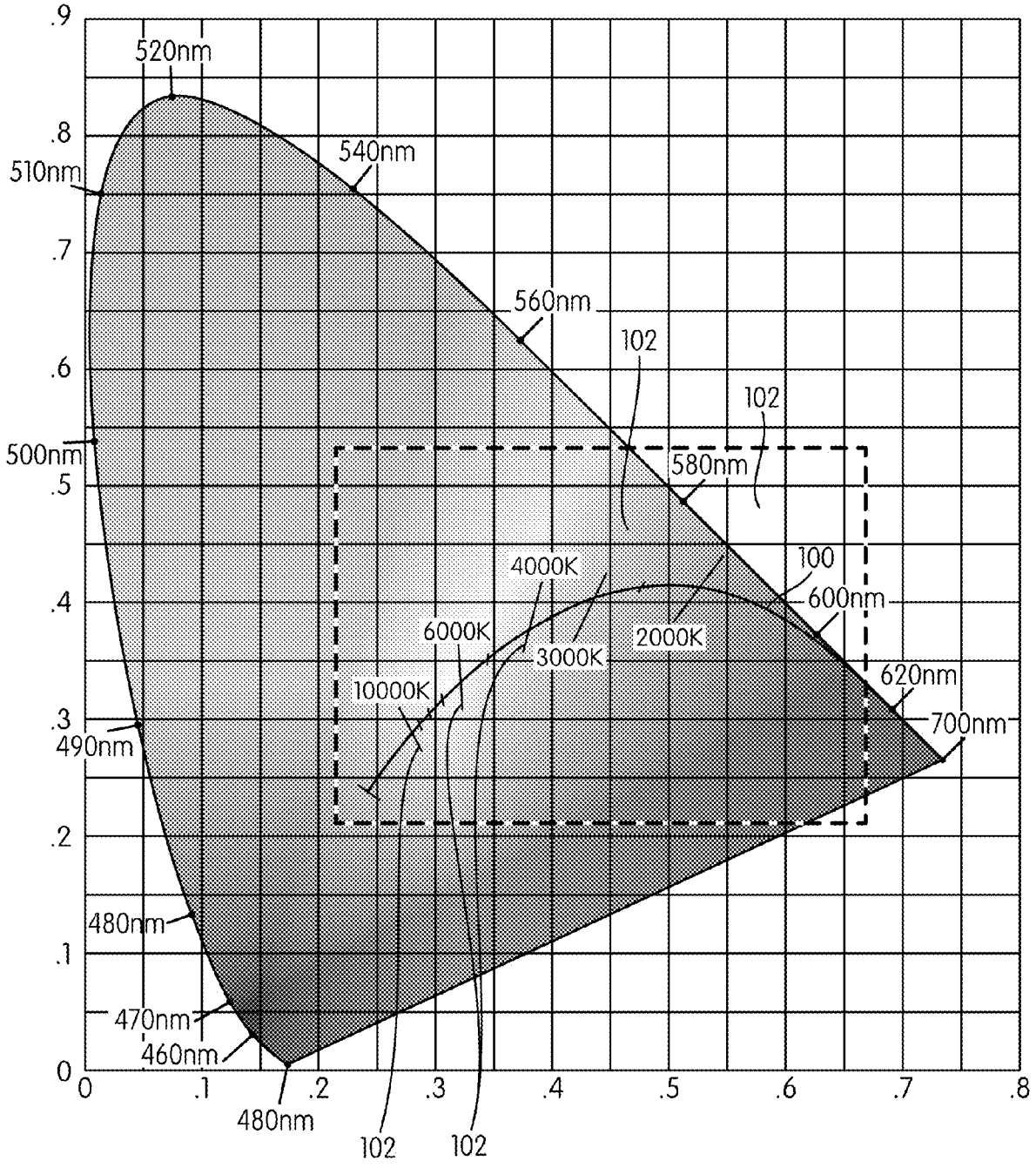
FIG. 4 is a rendering of the 1931 CIE color space.

FIG. 4 is a CIE 1931 color diagram, a graphical representation of an international standard model of human color vision. While a full description of the CIE 1931 color diagram is beyond the scope of this document, certain features of the color model it represents are particularly relevant to embodiments of the present invention. In short, the CIE 1931 color diagram allows for precise specification of colors using an X-Y coordinate system.

As was described briefly above, "white" light sources are often described in terms of their color temperatures. This is because most natural (i.e., incandescent) light sources approximate a black body radiator—an object whose color is determined only by its temperature. On the CIE 1931 diagram, the colors that a black body radiator would take at various temperatures lie along the Planckian locus, also referred to as the black body locus, and generally indicated at 100 in FIG. 4. The Planckian locus 100 is a curve that traverses from deep red at relatively low temperature through orange, yellow-white, white, and blue-white. The function that defines the Planckian locus 100 is well known; its precise values can be calculated directly or approximated using any number of functions. For example, the Planckian locus is often approximated as a cubic spline whose segments depend on the color temperature.

FIG. 5 is an illustration of the portion of the CIE 1931 color diagram immediately around the Planckian locus 100. Above the Planckian locus 100 lie oranges, greens, and blues; below it lie primarily reds and pinks. The points on the Planckian locus 100 that correspond to various color temperatures are marked with isotherm lines 102. The length of the isotherm lines 102 indicates the maximum distance out from the Planckian locus 100 to which the marked CCT is considered to be valid. Beyond the isotherm lines 102, color coordinates are used instead of a CCT to describe a color. In the views of FIGS. 4-5, the isotherm lines 102 are somewhat exaggerated for clarity in explanation.

LED light engines, like other man-made light sources, are usually made to emit light with a color that falls along the Planckian locus. In standard photometric and colorimetric testing, such as the Illuminating Engineering Society of North America's LM-79 test method, the color coordinates of an LED light source are measured, as is the distance of those color coordinates from the Planckian locus 100. (The distance from the Planckian locus 100 is measured as Duv, using the (u, v) coordinate system of the CIE 1960 color space.)

Although significant effort is made to see that LED light engines emit a color of light that falls along the Planckian locus 100 in steady state, less attention is usually given to the kind of transitions described above. If an incandescent light source is dimmed, its temperature gradually decreases, and it traverses the Planckian locus 100 until it no longer emits light in the visible range. This causes most incandescent light to develop a warm orange or red hue as it shuts off.

LED light engines, by contrast, are usually set to make a linear transition from one color temperature to another. As an example of this, in FIG. 5, a first transition 104 between 5500K and 2500K is marked. As can be seen, this linear transition may cause colors that are below the Planckian locus 100 to be emitted during the transition, giving the emitted light a momentary pink or orange hue that would not be emitted by a traditional incandescent light source whose transition from on to off traverses the Planckian locus 100. The Duv of such a transition, the distance of the color coordinates of the emitted light from the Planckian locus 100, will depend on the nature of the transition. As another example, a second transition 106 between 5500K and 2000K may have a larger Duv for part of the transition than the first transition 106, as can be seen in FIG. 5. As can also be appreciated from FIG. 5, the greater the magnitude of a linear transition between color temperatures, the larger the Duv may be at certain points during the transition.

For this reason, it may be desirable to manage the color temperatures or colors of the emitted light during a transition from one color temperature to another. As an example, FIG. 6 illustrates the same portion of the 1931 CIE color space as FIG. 5, with the Planckian locus 100 and a color temperature transition 110 according to one embodiment of the present invention. In contrast to the straight, linear transitions 104, 106 illustrated in FIG. 5, the transition 110 of FIG. 6, a transition from 6000K to 2000K, is segmented, moving from 6000K to 5000K, then 5000K to 4000K, 1000K at a time until it reaches 2000K. While the transitions between color temperatures in each segment are still linear, the transition 110 as a whole more closely approximates the Planckian locus 100, with a smaller maximum Duv in each segment.

In various embodiments of the invention, color temperature transitions may be implemented as linear-segment transitions, like the transition 110 of FIG. 6. Such transitions could also follow splined paths between one color temperature and the text. All of these sorts of transitions should be considered "nonlinear" transitions between one color temperature and another. It could also be said that color transitions in embodiments of the invention maintain a constant or near-constant Duv relative to the Planckian locus 100 during the transition.

Transitions between color temperatures in embodiments of the invention may allow some variation in the perceived color during the transition. For example, a color variation of 3 SDCM (i.e., 3 McAdam ellipses) may be permissible. That corresponds to about ±0.003 Duv.

The description above speaks of maintaining an "ideal" color of light through a transition. Such "ideal" transitions may or may not fall along the Planckian locus 100. What is considered "ideal" may vary with the application for which a luminaire is to be used, as well as the observers. For example, research from a team at the National Institute of Standards and Technology using a small group of observers of varying ages seems to show that light with a Duv of between −0.02 and −0.01 (i.e. below the Planckian locus 100) was "most acceptable" to the widest range of observers for the widest range of color temperatures (Ohno, Y. and Fein, R., "Vision Experiment on White Light Chromaticity for Lighting: Duv Levels Perceived Most Natural," CIE/USA-CNC/CIE Biennial Joint Meeting, Davis, Calif., Nov. 7-8, 2013, the contents of which are incorporated by reference herein in their entirety).

In the description above, two sets of LED light engines 18, 20 are described in a single luminaire. Depending on the nature of the transition, it may be possible to control the color of the emitted light as described above solely by mixing light from the two sets of LED light engines 18, 20. However, it may not always be possible to implement a transition that traverses the Planckian locus 100 using only two sets of LED light engines 18, 20. In some cases, additional LED light engines that emit other color temperatures may be included to facilitate ideal color temperature transitions. Alternatively, RGB LED light engines may be included to help with color correction during color temperature transitions by "doping" the emitted light with red, green, or blue as needed.

The above description covers both maintaining the light output during a transition and maintaining an ideal color during a transition. While systems and methods according to embodiments of the invention may manage both of these things simultaneously, in some cases, one may be more important than the other. For example, in a dim-to-warm application, it may be helpful to maintain ideal color during a transition from, say, 5000K to 2700K, but it may also be perfectly appropriate for the light output to fall off as the color temperature decreases, in order to simulate a cooling incandescent light source with its increasingly red-orange light and decreasing light output. In various embodiments of the invention, the light output may be managed alone, the color of the emitted light may be managed alone, or both may be managed together.

While the invention has been described with respect to certain embodiments, the description is intended to be exemplary, rather than limiting. Modifications and changes may be made within the scope of the invention, which is defined by the appended claims.

What is claimed is:

1. A method, comprising:

receiving an instruction to transition between a first color temperature of white light and a second color temperature of white light using a solid-state lighting circuit capable of producing the first color temperature of white light and the second color temperature of white light; and executing a segmented transition between the first color temperature of white light and the second color temperature of white light, each segment of the segmented transition having a smaller maximum Duv than a direct linear transition between the first color temperature of white light and the second color temperature of white light.

2. The method of claim 1, wherein:

the first color temperature of white light is emitted by a first set of LED light engines and the second color temperature of white light is emitted by a second set of LED light engines.

3. The method of claim 2, wherein:

the first set of LED light engines comprises a first pump LED and a first phosphor mix; and the second set of LED light engines comprises a second pump LED and a second phosphor mix.

4. The method of claim 1, wherein the first set of LED light engines and the second set of LED light engines are physically in a single set of LED packages.

5. The method of claim 4, wherein each of the single set of LED packages has at least two different phosphor mixes.

6. The method of claim 1, further comprising:

during said executing, emitting a color doping light comprising one or more of red, green, or blue light additively to create the smaller maximum Duv.

7. The method of claim 6, further comprising emitting one or both of the first color temperature of white light and the second color temperature of white light with the color doping light.

8. The method of claim 1, wherein the segmented or nonlinear transition comprises a splined path that approximates the shape of the Planckian locus between the first color temperature of white light and the second color temperature of white light.

9. The method of claim 1, wherein the segmented or nonlinear transition comprises a first segmental transition between the first color temperature of white light and an intermediate color temperature of white light and a second segmental transition between the intermediate color temperature of white light and the second color temperature of white light, the intermediate color temperature of white light having a color temperature between that of the first color temperature of white light and the second color temperature of white light.

* * * * *